United States Patent [19]

Andrich

[11] 4,307,598

[45] Dec. 29, 1981

[54] TOOL FOR COLLAPSING HOLLOW-WALL ANCHORS

[76] Inventor: Michael S. Andrich, 2400 S. Loop West #616, Houston, Tex. 77054

[21] Appl. No.: 148,691

[22] Filed: May 12, 1980

[51] Int. Cl.[3] ..... B21B 31/00

[52] U.S. Cl. ..... 72/391; 72/114

[58] Field of Search ..... 72/391, 114, 409; 29/243.53, 243.54; 81/302

[56] References Cited

U.S. PATENT DOCUMENTS

| | | | |
|---|---|---|---|
| 1,102,937 | 7/1914 | Malaby | 72/391 |
| 2,115,251 | 4/1938 | Buck | 72/449 |
| 2,430,563 | 11/1947 | Gill | 72/391 |
| 2,582,417 | 1/1952 | Croessant | 72/391 |
| 4,038,851 | 8/1977 | Coloma | 72/114 |
| 4,086,799 | 5/1978 | Brendle | 72/114 |

*Primary Examiner*—Gene P. Crosby
*Attorney, Agent, or Firm*—Darryl M. Springs

[57] ABSTRACT

In one exemplar embodiment a tool for collapsing hollow-wall anchors is disclosed. The tool includes a pair of elongated handles one of which is designed to remain stationary while the other is mounted in a spaced-apart relationship to the stationary handle for limited pivotal movement with respect thereto. One end of the stationary handle has a head including an open-ended base plate with a slot disposed therein for accepting the shank of the bolt of a conventional wall anchor. A jaw member is pivotally attached to one end of the pivotable handle and adaped for reciprocal movement with respect to the base plate of the head. The jaw also has a slot disposed therein for engaging the head of the bolt for exerting an outward axial force on the anchor bolt when the pivoting handle is closed toward the stationary handle to collapse the anchor. Spring means disposed between the handles resists the closure force exerted on the pivoting handle and returns the pivoting handle to an open position when closure force is removed.

6 Claims, 5 Drawing Figures

TOOL FOR COLLAPSING HOLLOW-WALL ANCHORS

BACKGROUND OF THE INVENTION

The present invention relates to tools for setting a conventional hollow-wall anchor by exerting a tension force axially on the screw provided with such anchors.

DESCRIPTION OF THE PRIOR ART

Hollow-wall anchors are permanently deformable selfanchoring fasteners for threaded members such as bolts or screws for application to walls for supporting shelf brackets or other heavy object to be hung on the wall such fasteners can be inserted into a hole in the wall such as a wall board or other structural support member such that the deformable end of the anchor can be deformed from the outside of the wall member and anchor the fastener to the member. The wall anchor is usually deformed by screwing the bolt or screw into the anchor from the outside of the wall board or support member to deform the anchor on the inside of the wall anchor. However, considerable amount of time and effort is utilized to screw the bolt or screw into the wall anchor to deform the collaspable legs behind the wall board surface, and then to unscrew the bolt or screw from the collapsed anchor. For professional builders and carpenters, the time and effort to set numerous wall anchors can be sizeable.

There are presently no commercial tools available for performing such an operation in one movement or action, but the prior art discloses several prior patented devices for axially applying a force to the screw or bolt of the anchor for setting and collapsing the anchor to fasten it in place as in the following U.S. Pat. Nos.: 1,102,937 (Malaby); 2,399,442 (Luce); 4,118,966 (Jackson). However, the tools disclosed in such prior art are not practical for the following reasons: The tool disclosed in the patent to Malaby is designed for a specific type of wall anchor utilizing a screw or bolt having a specially designed head with a cross member and such a wall anchor is not available on the market at the present time. Accordingly, the tool is not designed to be utilized with the conventional fasteners that are presently on the market. The tools disclosed in both the Luce and Jackson patents can be utilized with presently available wall anchors, however, the bolt or screw must be removed from the wall anchor, and a special operating member having a threaded end is inserted into the wall anchor in place of the anchor screw or bolt. The operating member is then movable by a pair of handles to exert an axial force on the operating member to collapse the wall anchor. Then the operating member must be unscrewed and the conventional screw or bolt of the wall anchor is then reinserted.

There are presently on the market tools for setting hollow rivets and the like which exert an axial force on the rivet mandrel to collapse the rivet and then shear off the mandrel to form the final riveted fastener. However, all of these tools require various vise-type members to grip the rivet mandrel and to provide sufficient gripping strength to collapse the rivet body and then shear the mandrel to form the rivet. Such prior art is shown by the following U.S. Pat. Nos.: 2,430,563 (Gill); 3,003,657 (Siebol et al); 3,154,210 (Elliott et al); 3,646,800 (Martin); 3,760,627 (Richardson et al); and 3,886,782 (Miyamoto).

SUMMARY OF THE INVENTION

The present invention remedies the problems of the prior art by providing a simple tool for setting or collapsing a conventional hollow-wall anchor.

The tool includes a pair of elongated handles one of which is designed to remain stationary while the other is mounted in a spaced-apart relationship to the stationary handle for limited pivotal movement with respect thereto. One end of the stationary handle has a head including an open-ended base plate with a slot disposed therein for accepting the shank of the bolt of a conventional wall anchor. A jaw member is pivotally attached to one end of the pivotable handle and adopted for reciprocal movement with respect to the base plate of the head. The jaw also has a slot disposed therein for engaging the head of the bolt for exerting an outward axial force on the anchor bolt when the pivoting handle is closed toward the stationary handle to collapse the anchor. Spring means disposed between the handles resists the closure force exerted on the pivoting handle and returns the pivoting handle to an open position when closure force is removed.

BRIEF DESCRIPTION OF THE DRAWINGS

In order that the manner in which the above-recited advantages and features of the invention are attained can be understood in detail, a more particular description of the invention may be had by reference to the specific embodiments thereof which are illustrated in the appended drawings, which drawings form a part of this specification. It is to be noted, however, that the appended drawings illustrate only typical embodiments of the invention and therefore are not to be considered limiting of its scope for the invention may admit to further equally effective embodiments.

In the drawings.

DETAILED DESCRIPTION OF THE PREFERRED EMBODIMENTS

Figure 1:
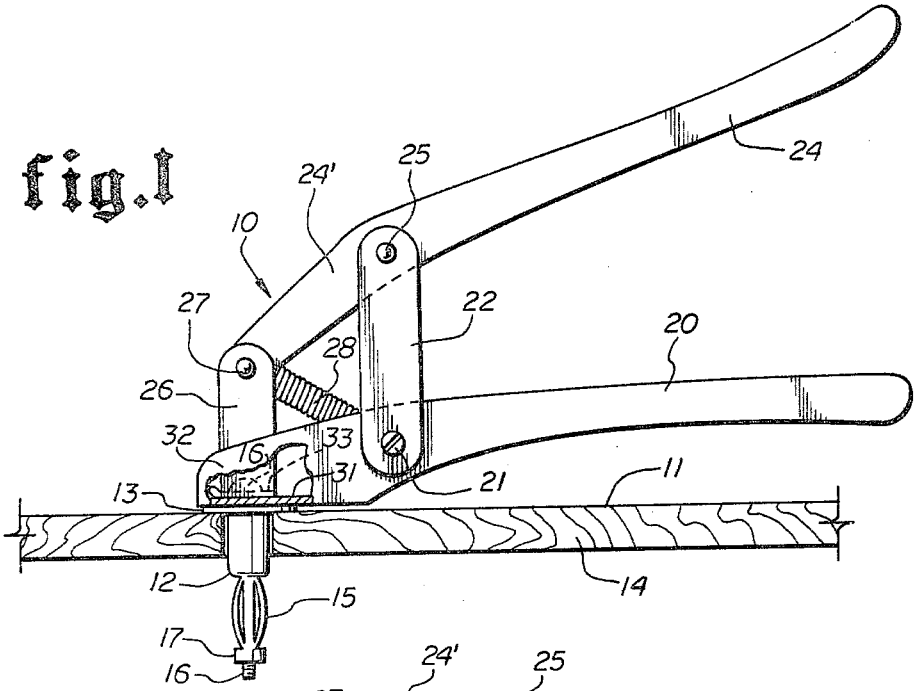
FIG. 1 is a side elevational view (partly in cross-section) showing a conventional wall anchor inserted through a hollow-wall board and engaged by the tool before collapsing the anchor.
Figure 2:
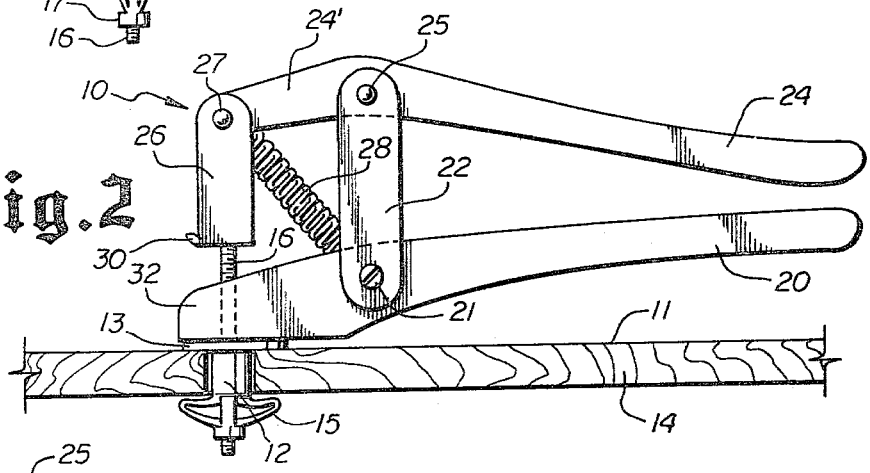
FIG. 2 is a side elevational view of the wall anchor and tool as shown in FIG. 1 after the tool has been actuated to deform the collapsable legs of the wall anchor.
Figure 3:
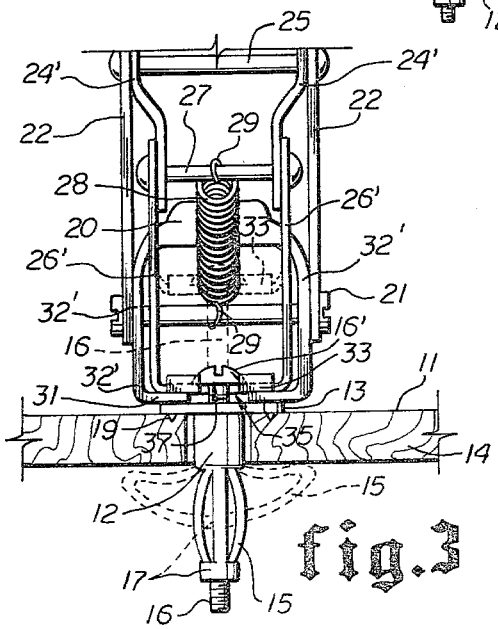
FIG. 3 is a partial detailed end view of the tool (slightly enlarged) that shows the engagement of the anchor screw by the tool before and after the anchor has been set in the wall board.

Referring now to FIGS. 1, 2 and 3, the operation of the tool 10 for setting hollow wall anchors will be described in detail. A conventionl hollow wall anchor 12 is shown inserted in a previously drilled hole in wall board 14. Anchor 12 has a flat flanged head 13 to engage the wall board surface 11 and to prevent passage of the anchor 12 completely through wall 14. The extending body of anchor 12 includes a plurality of deformable legs 15 that terminate in a screw retaining end 17, through which a screw 16 is threadably inserted. The screw head 16' projects above the flanged anchor head 13 as shown in FIGS. 1 and 3. Barbs 19 (see FIG. 3) are often supplied on the lower side of flanged head 13 to dig into the surface 11 of wall 14 to prevent rotation of anchor 12 when screw 16 is rotated when conventionally deforming or setting the anchor.

Tool 10 comprises a stationary handle 20, one end of which terminates in a generally U-shaped head member 32 having a spaced-apart pair of side members 32' and an integral flat base plate 31. Attached to each side of stationary handle 20 is an upright frame member 22 held rigidly in place by suitable fastening means, such as a double-ended rivet or bolt 21. A pivoting handle member 24 is pivotally mounted between the projecting ends of the upright projecting frame members 22 by means of a pivot pin 25, thereby permitting the shorter end 24' to project beyond pivot pin 25 and to be spaced above the head 32. Pivotally mounted by means of a pivot pin 27 on the end of member 24' is a jaw member 26 which engages anchor screw head 16' by means of a slotted base plate member 33 for deforming anchor 12 as will be hereinafter described in greater detail. A tension spring 28 is attached between pivot pin 27 and rivet or bolt 21 by means of spring retaining means 29, such spring hooks or clips. Spring 28 resists pivotal force applied downwardly on handle 24 and retains pivoting handle 24 in an "open" position when handle 24 is not actuated.

Figure 4A:
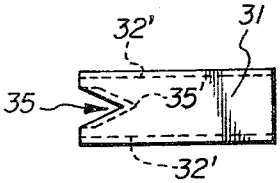
FIG. 4A is a fragmentary view of the bottom of the base plate showing the anchor screw engaging slot.
Figure 4B:
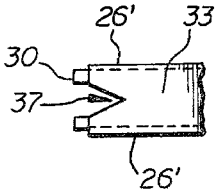
FIG. 4B is a fragmentary cross-section view of the jaw member showing the anchor screw engaging slot of the jaw base portion.

Referring additionally to FIG. 4, the jaw member 26 comprises a generally U-shaped member having elongated upwardly projecting sides 26' and an integral flat base portion 33. The free ends of sides 26' are mounted for pivotal movement with respect to the end 24' of the pivoting handle member 24 as above described. A slot 37, generally V or U-shaped, is disposed in jaw base 33 for engaging anchor screw 16 and screw head 16'. A slot 35 is disposed in the outward end of base plate 31 for engaging the shank of anchor screw 16. When no downward force is applied to handle 24, tension spring 28 acts to rotate end 24' downwardly to mate jaw member base portion 33 against the base plate 31 of had 32 (see FIG. 3). When in such a position, slot 37 in the outward end of jaw base portion 33 registers generally with the slot 35 in base plate 31. The outward edge of jaw member base 33 may terminate in a pair of upwardly protruding lips 30 to prevent disengagement of base section 33 of jaw member 26 from the anchor screw head 16' when upward axial deforming pressure is exerted on screw 16 as will be hereinafter further described. The slot 35 in base plate 31 may be a generally V-shaped slot as shown in FIG. 4A or it may be a more "rounded" U-shape as shown by dotted lines 35'. Slot 35 should generally be deep enough to accommodate a plurality of different diameter anchor screws (depending on the size of wall anchor 12) which generally range from 1/16" to 3/16". Slot 37 in jaw base 33 can be shallower than slot 35, as long as it is capable of accommodating the largest diameter anchor screw 16 and will securely engage the screw head 16'.

To operate the tool 10 for setting a hollow wall anchor 12, the anchor 12 is inserted into a hole in the wall 14 with flanged head 13 and barbs 19 engaging wall surface 11. Anchor screw 16 is unscrewed from the anchor screw retaining end 17 just enough to permit the insertion of screw 16 into the superimposed slots 35 and 37 of the base plate 31 of head 32 and jaw base portion 33, respectively. Base plate 31 is held firmly against the flat flanged anchor head 13 by means of handle 20. Downward force is applied to handle 24 (while maintaining handle 20 stationary) in order to pivot handle 24 downwardly toward handle 20, as shown in FIG. 2, thus exerting on upward force on portion 24' and jaw member 26 for exerting an upward and outward force axially on screw 16 and screw head 16' for raising screw 16 with respect to anchor head 13 and deforming anchor legs 15 to an expanded position as shown in FIGS. 2 and 3. When screw 16 has been raised to its maximum upward position, the anchor 12 is set with the deformed legs 15 engaging the back side of wall 14 to hold the anchor securely in place. Tool 10 is disengaged from screw 16 and screw head 16', and screw 16 can be removed by a few turns from anchor screw retaining end 17 for mounting a desired fixture.

Greater force can be applied to screw 16 if the length of tool handles 20 and 24 are increased to increase the leverage exerted on jaw member 26. When downward pressure is released from handle 24, tension spring 28 returns jaw member 26 to engagement or mating with base plate 31 of head 32 and rotates handle 24 to an open position, thus readying tool 10 for the next anchor deforming operation.

The tool could be constructed of sheet metal with rounded handles that would provide a strong, lightweight tool. Of course, jaw member 26 could be constructed to be removable from privoting arm 24' by means of a removable pivot pin 27 if a jaw member 26 having a different slot 37 or other screw head 16' engaging feature is desirable, or if the slot 37 cannot accommodate a sufficient variety of diameters of anchor screws 16.

Numerous variations and modifications may be made in the structure herein described without departing from the current invention. Accordingly, it should be clearly understood that the forms of the invention herein described and shown in the figures of the accompanying drawings are illustrative only and are not intended to limit the scope of the invention.

What is claimed is:

1. A tool for collapsing conventional hollow-wall anchors characterized by a collapsable anchor body and a headed bolt member cooperating therewith, comprising a first handle member, a head member fixed to one end of said handle member and including an open-ended flat base plate including an entry means disposed therein for permitting entry of the anchor bolt member into said base plate, frame means attached to said first handle member, a second handle member mounted for pivotal movement on said frame means and in an opposed spaced-apart relationship to said first handle member, an elongated jaw member having a flat base position and pivotally mounted on one end of said second handle member for permitting movement of said jaw member with respect to said head member, said jaw member including an engaging means cooperating with said entry means disposed in said base plate for engaging the head of the anchor bolt member threadably engaging the anchor body and exerting an axial force outwardly on the bolt head when force is applied to pivot said second handle member toward said first handle member, the bolt moving outwardly through said first slot disposed in said base plate in response to said axial force exerted by said jaw member to collapse the anchor, and spring means disposed between said first and second handle members for resisting downward force acting on said second handle member and for returning said second handle member to an open position when said force is removed.

2. The tool as described in claim 1, wherein said entry means disposed in said head member base plate comprises a first slot disposed in said base plate and communicating with said open end of said base plate.

3. The tool as described in claims 1 or 2, wherein said flat base portion of said jaw member mates with said head member base plate and wherein said engaging means included in said jaw member comprises a second slot disposed therein and communicating with an open edge of said jaw member and generally registering with said first slot disposed in said base plate for engaging the head of the anchor bolt member.

4. The tool as described in claim 3, wherein said jaw member base portion further includes upwardly protruding lips extending from said open edge of said member adjacent said second slot for preventing disengagement of the bolt head by said jaw member when axial force is applied to the anchor bolt.

5. A tool for collapsing conventional hollow-wall anchors characterized by a collapsable anchor body and a headed bolt member cooperating therewith, comprising a first handle member, a head member fixed to one end of said handle member and including an open-ended flat posed therein and communicating with said open end for permitting entry of the anchor bolt member into said slotted end, frame means attached to said first handle member, a second handle member mounted for pivotal movement on said frame means and in an opposed spaced-apart relationship to said first handle member, an elongated generally U-shaped jaw member pivotally mounted on one end of said second handle member for permitting movement of said jaw member with respect to said head member, said jaw member having a flat base portion for mating with said base plate of said head member and having a second slot disposed therein and communicating with one open edge of said jaw member and generally registering with said first slot disposed in said base plate for engaging the head of the anchor bolt member threadably engaging the anchor body and exerting an axial force outwardly on the bolt head when force is applied to pivot said member toward said first handle member, the bolt moving outwardly through said first slot disposed in said base plate in response to said axial force exerted by said jaw member to collapse the anchor, and spring means disposed between said first and second handle members for resisting downward force acting on said second handle member and for returning said second handle member to an open position when said force is removed.

6. The tool as described in claim 5, wherein said jaw member base portion further includes upwardly protruding lips extending from said open edge of said member adjacent said second slot for preventing disengagement of the bolt head by said jaw member when axial force is applied to the anchor bolt.

* * * * *